United States Patent [19]

Ivel

[11] 4,274,388

[45] Jun. 23, 1981

[54] METHOD AND APPARATUS FOR DRESSING GRINDING WHEELS

[75] Inventor: Leonard L. Ivel, Leicester, Mass.

[73] Assignee: The Warner & Swasey Company, Cleveland, Ohio

[21] Appl. No.: 84,717

[22] Filed: Oct. 15, 1979

[51] Int. Cl.[3] ..... B24B 53/08

[52] U.S. Cl. ..... 125/11 TP; 51/325

[58] Field of Search ..... 125/11 R, 11 TP, 11 PH, 125/11 PT; 51/325

[56] References Cited

U.S. PATENT DOCUMENTS

| | | | |
|---|---|---|---|
| 2,151,802 | 3/1939 | Roman | 125/11 |
| 2,187,690 | 1/1940 | Martin | 125/11 |
| 2,832,330 | 4/1958 | Hughes | 125/11 |
| 3,271,908 | 9/1966 | Rocks | 125/11 TP |
| 3,313,285 | 4/1967 | Price | 125/11 R |
| 3,491,741 | 1/1970 | Flohr | 125/11 R |
| 4,160,438 | 7/1979 | Fujita | 125/11 TP |

FOREIGN PATENT DOCUMENTS

| | | | |
|---|---|---|---|
| 806629 | 12/1958 | United Kingdom | 125/11 PH |

*Primary Examiner*—Harold D. Whitehead
*Attorney, Agent, or Firm*—Yount & Tarolli

[57] ABSTRACT

Disclosed is a method and apparatus which uses a single cam surface to dress operating surfaces of grinding wheels having different configurations. A grinding wheel having an operating surface with a first configuration is positioned adjacent to the wheel dressing tool. A cam follower is moved along the single cam surface to move the wheel dressing tool to dress the operating surface of the grinding wheel to a first configuration. A second grinding wheel having an operating surface with a second configuration is subsequently positioned adjacent to the dressing tool. A second cam follower having a configuration which is different than the configuration of the first cam follower is positioned to engage the same cam surface as was used during the dressing of the first grinding wheel. Movement of the dressing tool is effected by the inneraction between the second cam follower and the cam surface to move the dressing tool to dress the operating surface of the second grinding wheel to the second configuration.

5 Claims, 4 Drawing Figures

METHOD AND APPARATUS FOR DRESSING GRINDING WHEELS

BACKGROUND OF THE INVENTION

This invention relates to a method and apparatus for dressing griding wheels having operating surfaces with different configurations.

It is well known that, through use, the operating surface of a grinding wheel will become worn. Thus, it is necessary to periodically dress the operating surface of the grinding wheel with a wheel dressing assembly. A known wheel dressing assembly includes a cam surface which has a configuration which corresponds to the desired configuration for the operating surface of the grinding wheel. During a wheel dressing operation, a cam follower is moved along the cam surface to cause a dressing tool to move axially and radially along the operating surface of the grinding wheel. In this manner, a configuration corresponding to the configuration of the cam surface is transferred to the operating surface of the grinding wheel to dress the grinding wheel.

In this known wheel dressing assembly, the cam follower has a pointed or chisel-like shape so that there is point contact between the cam follower and the cam surface. In order to dress grinding wheels having different operating surface configurations, it is necessary to provide a plurality of cam surfaces corresponding to the desired configurations. This operation involves substantial time and expense to produce even minor variations in grinding wheel operating surface configurations. Patents describing wheel dressing assemblies of this known type include U.S. Pat. Nos. 2,151,802; 2,187,690; 2,832,330; and 3,008,461.

SUMMARY OF THE INVENTION

The present invention provides a new and improved method and apparatus using a single cam to dress grinding wheels having operating surfaces with different configurations. Variations in grinding wheel operating surface configuration are accommodated by the use of cam followers having different shapes. The various cam followers effect different movements of a wheel dressing tool as each of the followers is moved in turn along the single cam surface to dress the different grinding wheels.

In accordance with another feature of the present invention, the shape of a portion of the dressed grinding wheel is determined by the configuration of the cam while the shape of another portion of the dressed grinding wheel is determined by the configuration of the cam follower. Thus during a portion of a wheel dressing operation, the cam follower surface is moved along the cam surface to effect movement of the wheel dressing tool as a function of the shape of the cam surface and independently of the shape of the cam follower surface. During a second portion of the wheel dressing operation, the cam follower surface is maintained in engagement with and moved relative to one particular portion of the cam surface. This results in the dressing tool being moved as a function of the shape of the cam follower surface and independently of the shape of the cam surface.

Accordingly, it is an object of this invention to provide a new and improved method and apparatus for dressing grinding wheels having operating surfaces with different configurations and wherein a single cam is used with a plurality of followers having different configurations.

Another object of this invention is to provide a new and improved method and apparatus for dressing grinding wheels and wherein a wheel dressing tool is moved as a function of the configuration of a cam follower surface during a portion of a wheel dressing operation.

BRIEF DESCRIPTION OF THE DRAWINGS

The foregoing and other features of the present invention will become more apparent upon a consideration of the following description taken in connection with the accompanying drawings forming a part of this specification and in which.

DESCRIPTION OF ONE SPECIFIC PREFERRED EMBODIMENT OF THE INVENTION

Figure 1:
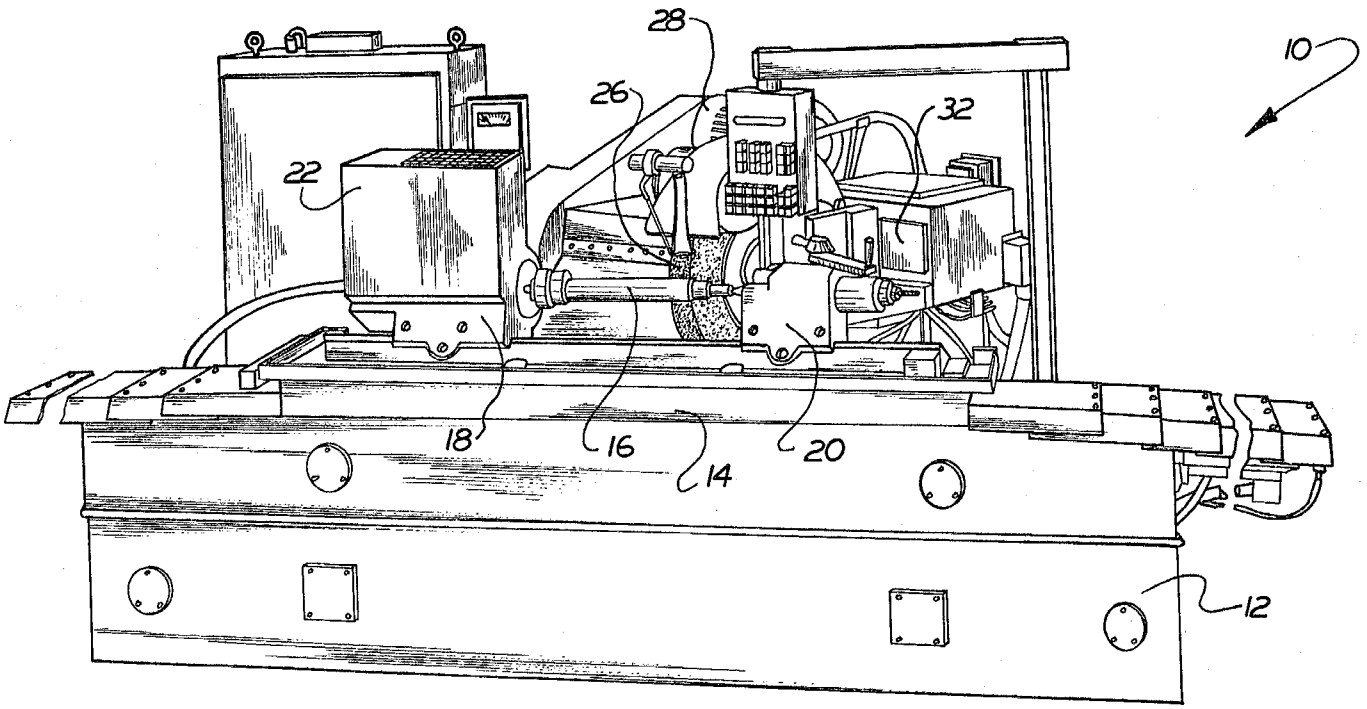
FIG. 1 is an elevational view of a grinding machine having a wheel dressing assembly constructed and operated in accordance with the present invention.

A grinding machine 10 is illustrated in FIG. 1 and includes a base 12 upon which a movable workpiece carriage or table 14 is mounted for movement under the influence of a motor and drive screw (not shown) during a grinding operation. A workpiece 16 is rotatably supported on the carriage 14 by a head stock 18 and tailstock 20. During a grinding operation, the workpiece is rotated by a drive motor 22 in a known manner.

A grinding wheel 26 is rotatably mounted on a wheel slide for movement toward and away from the workpiece 16. A grinding wheel drive motor 28 is connected with the grinding wheel 26 and is operable to rotate the grinding wheel about its central axis during a grinding operation. The construction of the grinding machine 10 is set forth in U.S. Pat. No. 4,115,958 and will not be further described herein in order to avoid prolixity of description. However, it should be understood that the invention disclosed herein is not limited to use with any one specific type of grinding machine.

Figure 2:
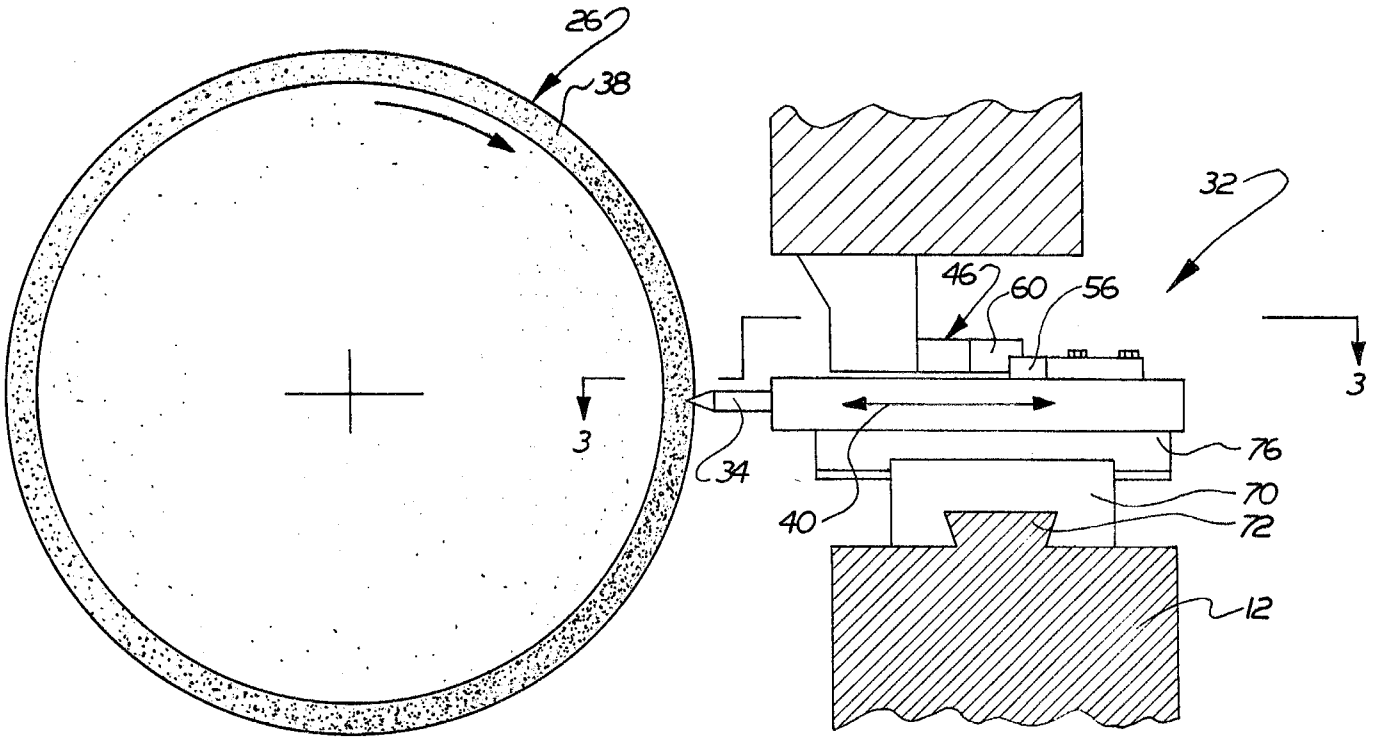
FIG. 2 is an enlarged size elevational view of the wheel dressing assembly used in the grinding machine of FIG. 1.
Figure 3:
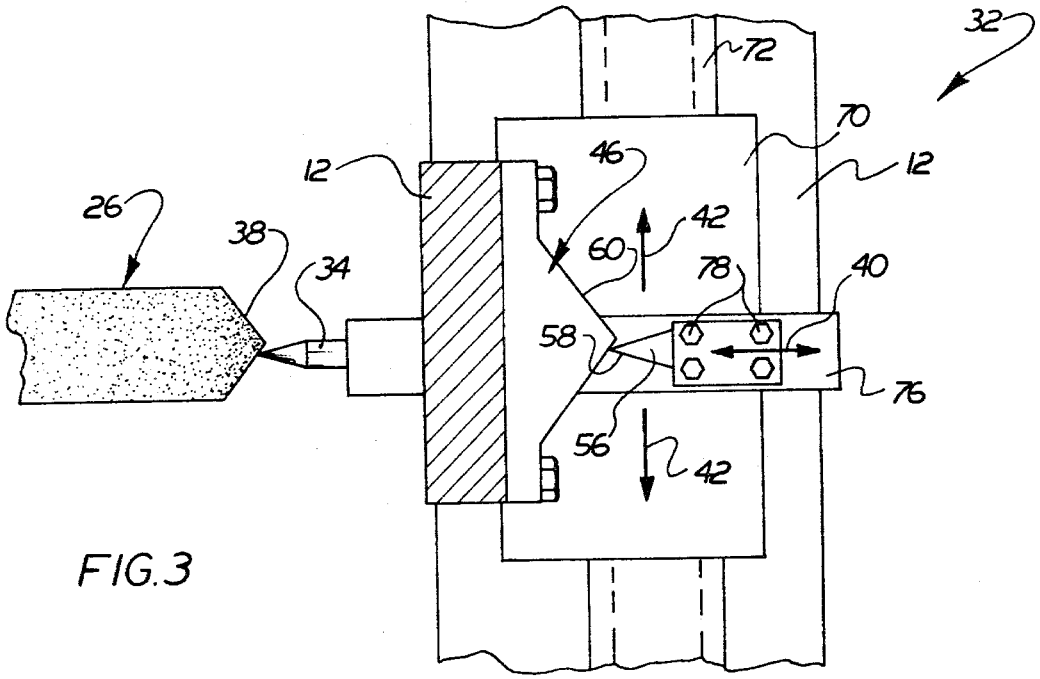
FIG. 3 is a view , taken along the line 3—3 of FIG. 2, illustrating the relationship between a cam and cam follower in the wheel dressing assembly.
Figure 4:
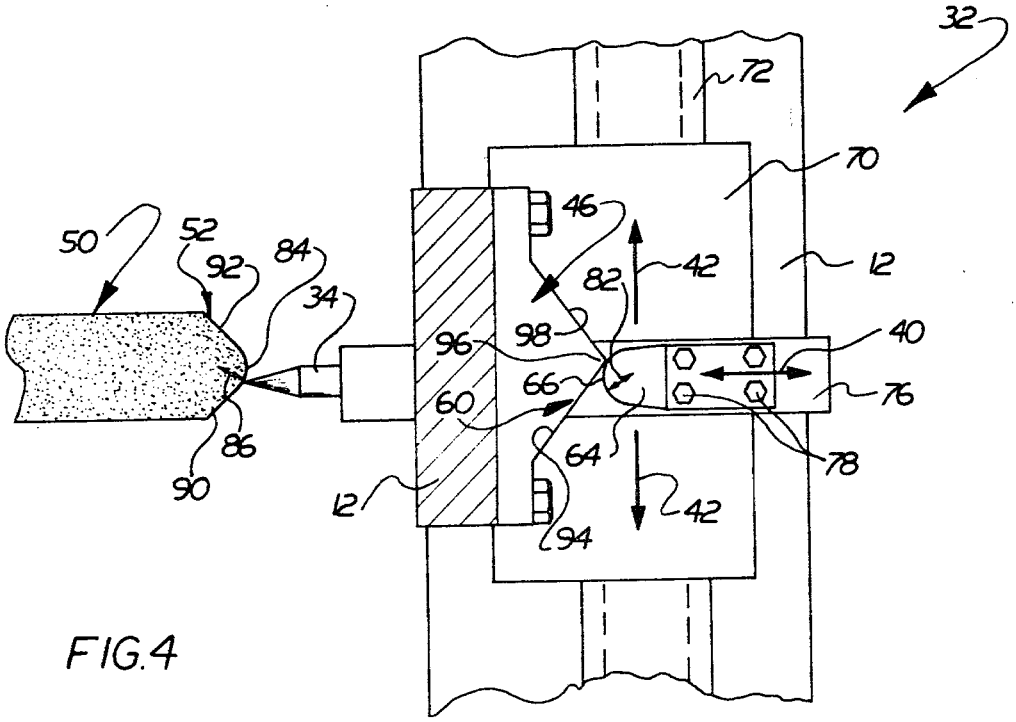
FIG. 4 is a view, similar to FIG. 3, illustrating the use of the cam in association with a second cam follower to dress a grinding wheel having an operating surface with a configuration which is different than the grinding wheel operating surface configuration shown in FIG. 3.

A wheel dressing assembly 32 which is constructed and operated in accordance with the present invention is illustrated in FIGS. 2–4 and is used to dress the grinding wheel 26 when it becomes worn due to engagement with the workpiece 16 during grinding operations. The wheel dressing assembly 32 includes a dressing tool 34 (FIGS. 2 and 3) of the single point type. The tool 34 is used to dress an operating surface 38 disposed on the circumference of the circular grinding wheel 26.

During a wheel dressing operation, the wheel dressing tool 34 is moved radially of the grinding wheel 26 in the direction of the arrows 40 (FIGS. 2 and 3). In addition, the dressing tool 34 is moved along the axis of rotation of the grinding wheel 26 in the direction of the arrows 42 in FIG. 3 during a wheel dressing operation. During this movement of the wheel dressing tool 34, material is removed from the worn operating surface 38 on the grinding wheel 26 to return the operating surface to the original or desired configuration illustrated in FIG. 3.

In accordance with a feature of the present invention, a single cam 46 is utilized to effect movement of the dressing tool 34 to dress a grinding wheel 26 having an operating surface 38 with the configuration shown in FIG. 3 and to effect movement of the dressing tool 34 to dress a second grinding wheel 50 (FIG. 4) having an operating surface 52 with a configuration which is different from the configuration of the operating surface 38 of the grinding wheel 26 (FIG. 3). This is accomplished by using different cam followers in association with the cam 46 to modify the movement of the dressing tool 34 to correspond to the configuration of the particular grinding wheel operating surface being dressed. Thus, a cam follower 56 (FIG. 3) has a sharply pointed follower surface 58 which cooperates with a surface 60 on the cam 46 to move the dressing tool 34 to dress the operating surface 38 on the grinding wheel 26.

When the operating surface 52 (FIG. 4) on the grinding wheel 50 is to be dressed, the cam follower 56 is removed and a second cam follower 64 (FIG. 4) having a rounded follower surface 66 is used in association with the cam 46. The second cam follower 64 cooperates with the cam surface 66 to move the dressing tool 34 to shape the operating surface 52 of the grinding wheel 50. Although the cam follower 56 is removed and the separate cam follower 64 substituted in its place in the illustrated embodiment of the invention, the cam followers 56 and 64 could be interconnected and indexed into and out of engagement with the cam 46 if desired. In addition, if grinding wheels having operating surfaces with still other configurations were to be dressed, cam followers having configurations other than the configurations shown in FIGS. 3 and 4 would be provided to cooperate with the single cam 46 to effect the desired movement of the dressing tool 34.

The wheel dressing assembly 32 is disposed on the base 12 of the grinding machine 10 and includes a carriage 70 (FIG. 2) which is moved along a linear track 72 by suitable drive screw and motor (not shown). This moves the cam follower 56 or 64 and the wheel dressing tool 34 relative to the cam 46 along a path extending parallel to the axis of rotation of the grinding wheel 26 or 50. A tool slide 76 is mounted on the carriage 70 and is moved in a direction perpendicular to the axis of rotation of the grinding wheel 26 or 50 by the interaction between the cam follower 56 or 64 and the single cam 46. Movement of the wheel slide 76 relative to the carriage 70 moves the dressing tool 34 radially relative to the grinding wheel 26. A suitable spring assembly (not shown) is connected between the tool slide 76 and carriage 70 to urge the cam follower into abutting engagement with the surface 60 of the cam 46.

During operation of the dressing assembly 32 to dress the circular operating surface 38 of the grinding wheel 26 as shown in FIG. 3, cam follower 56 moves with carriage 70 in the direction of the arrows 42. Cooperation between the cam follower surface 58 and the cam surface 60 as the carriage moves along the track 72 causes movement of the tool slide 76 toward and away from the grinding wheel 26. This results in movement of the point of dressing tool 34 along a path which corresponds to the desired configuration of the operating surface 38 of the grinding wheel 26.

In order to dress a second grinding wheel 50 utilizing the same wheel dressing assembly 32, the cam follower 56 is removed from tool slide 76 by removing bolts 78. As shown in FIG. 4, the second cam follower 64 is then positioned on the tool slide 76 by reattaching the bolts 78. Of course, the cam followers 56 and 64 could be interconnected in such a manner as to enable the cam followers to be shifted into and out of engagement with the cam surface 46 by performing an indexing operation.

In a manner similar to that as described for grinding wheel 26 of FIG. 3, the operating surface 52 of the grinding wheel 50 is dressed by the wheel dressing assembly 32. Thus, the cam follower surface 66 on the cam 64 cooperates with the cam surface 60 to reciprocate the wheel dressing tool 34 in a radial direction as the carriage 70 moves along the track 72. This causes the tip of the dressing tool 34 to be moved along a path which corresponds to the desired surface configuration of operating surface 52 of grinding wheel 50.

The cam follower surface 56 has a radius of curvature which is indicated at 82 in FIG. 4. The cooperative movement between follower 64 and cam 46 causes the dressing tool 34 to move in a curved path around the nose 84 of the grinding wheel 50. The nose 84 of the grinding wheel 50 has a radius of curvature 86 which is the same as the radius of curvature 82 of cam follower surface 66.

It will be understood that by varying the radius of curvature 82 of the cam follower surface 66, other configurations for the operating surface of various grinding wheels can be accommodated. It will be further understood that other cam follower surface configurations may be provided.

In accordance with a feature of the embodiment of the invention shown in FIG. 4, side portions 90 and 92 of the operating surface 52 of the grinding wheel 50 are shaped as a function of the configuration of the cam 46 and the nose portion 84 is shaped as a function of the configuration of the cam follower surface 66. During movement of the wheel dressing tool 34 along the side portion 90 of the operating surface 52 on the grinding wheel 50, the cam follower 64 moves along a ramp portion 94 of the cam surface 60. During this movement, the cam ramp surface 94 has a line of contact at the same area on the cam follower surface 66. This results in the wheel dressing tool 34 being moved as a function of the configuration of the cam surface 60 and independently of the configuration of the cam follower surface 66.

When the cam follower 64 moves into engagement with a peak portion 96 of the cam surface 60 (see FIG. 4), the movement of the wheel dressing tool 34 is determined by the configuration of the cam follower surface 66 rather than the configuration of the cam surface 60. Thus, when the cam follower surface 66 engages the peak portion 96 of the cam surface 60, the area of line of contact between the cam follower surface 66 and cam surface 60 shifts relative to the cam follower 64 and remains constant relative to the cam surface 60. This results in the wheel dressing tool 34 being moved as a function of the configuration of the cam follower surface 66 and independently of the configuration of the cam surface 60.

Upon movement of the cam follower 64 into engagement with a second ramp portion 98 of the cam surface 60, the wheel dressing tool 34 is again moved as a function of the configuration of the cam surface 60 rather than as a function of the configuration of the cam follower surface 66. Thus, during movement of the cam follower 64 along the cam ramp 98, a line of contact is maintained between the cam follower surface 66 and the cam surface 60 at the same area on the cam 64. Therefore, the shape of the side portion 92 of the grinding wheel operating surface 52 is determined by the configuration of the cam 60 independently of the configuration of the cam follower surface 66.

In view of the foregoing description, it is apparent that the present invention provides a grinding wheel assembly 32 for use in a method for dressing a plurality of grinding wheels 26, 50 having different operating surface configurations 38, 52 by the substitution of cam followers 56, 64 having different follower surface configurations 58, 66. The different cam followers 56, 64 effect different movement of the wheel dressing tool 34 as each of the followers 56, 64 is moved in turn along a single cam surface 60.

Having described one specific embodiment of the invention, the following is claimed:

1. A method of dressing grinding wheels having operating surfaces with different configurations, said method comprising the steps of providing a wheel dressing tool, providing a single cam surface having a predetermined configuration, providing first and second cam followers having follower surfaces with different configurations, positioning the first cam follower surface in engagement with the cam surface, moving the dressing tool along a first path having a configuration corresponding to the configuration of a first grinding wheel operating surface by effecting relative movement between the cam surface and the first cam follower surface having a first configuration while the dressing tool is disposed in engagement with the operating surface of the first grinding wheel and while the first cam follower surface is disposed in engagement with the cam surface, positioning the second cam follower surface having a second configuration which is different from the first configuration in engagement with the cam surface, moving the dressing tool along a second path having a configuration corresponding to the configuration of the operating surface of a second grinding wheel by effecting relative movement between the cam surface and the second cam follower surface while the dressing tool is disposed in engagement with the operating surface of the second grinding wheel.

2. A method as set forth in claim 1 wherein the step of moving the dressing tool along the first path includes the step of moving the first cam follower and dressing tool together relative to the cam surface with the first cam follower disposed in abutting engagement with the cam surface, and said step of moving the dressing tool along the second path includes the step of moving the second cam follower along the cam surface with the second cam follower surface disposed in abutting engagement with the cam surface.

3. A method as set forth in claim 1 further including the step of maintaining the spacial relationship between the central axis of the grinding wheel operating surfaces and the cam surface constant during performance of the step of moving the dressing tool along the first and second paths.

4. A method as set forth in claim 1 wherein said step of moving the dressing tool along a second path includes the step of engaging the cam surface with a first portion of the second cam follower surface during movement of the dressing tool along a first portion of the second path and engaging the cam surface with a second portion of the second cam follower surface during movement of the dressing tool along a second portion of the second path.

5. An apparatus for dressing grinding wheels having operating surfaces with differing configurations comprising means for positioning the grinding wheel in a fixed position relative to a base structure, carriage means mounted on said base structure and adapted for movement in a first direction relative to the grinding wheel, a slide bar mounted on said carriage means being movable toward and away from the grinding wheel in a second direction which is transverse to said first direction, dressing means mounted on said slide bar for contacting the operating surface of the grinding wheel and removing portions thereform, a single cam surface mounted in a fixed position relative to said base and the grinding wheel and a plurality of interchangeable cam followers, each cam follower having a follower surface with configuration differing from the configuration of the remaining cam followers, each cam follower being selectively mountable on said slide bar so the follower surface of each cam follower engages the cam surfaces whereby each cam follower defines a differing path of movement for the dressing tool when in abutment with said cam surface and thereby, forms a different operating surface on the different grinding wheels.

* * * * *